US011553284B2

(12) United States Patent
Antonsen et al.

(10) Patent No.: US 11,553,284 B2
(45) Date of Patent: Jan. 10, 2023

(54) DETECTION OF FILTER CLOGGING FOR HEARING DEVICES

(71) Applicant: GN Hearing A/S, Ballerup (DK)

(72) Inventors: Frank Antonsen, Copenhagen (DK); Laurids Egedal Kirchhoff, Copenhagen (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 17/511,498

(22) Filed: Oct. 26, 2021

(65) Prior Publication Data

US 2022/0150647 A1 May 12, 2022

(30) Foreign Application Priority Data

Nov. 11, 2020 (DK) ..... PA 2020 70745

(51) Int. Cl.
*H04R 25/00* (2006.01)

(52) U.S. Cl.
CPC ..... *H04R 25/305* (2013.01); *H04R 25/554* (2013.01); *H04R 25/654* (2013.01); *H04R 2225/31* (2013.01); *H04R 2225/39* (2013.01); *H04R 2225/55* (2013.01)

(58) Field of Classification Search
CPC .. H04R 25/305; H04R 25/554; H04R 25/654; H04R 2225/31; H04R 2225/55; H04R 2225/39
See application file for complete search history.

(56) References Cited

U.S. PATENT DOCUMENTS

| | | | | |
|---|---|---|---|---|
| 10,057,694 | B2 | 8/2018 | Pedersen et al. | |
| 10,835,931 | B2 * | 11/2020 | Aase | B08B 17/04 |
| 2008/0253579 | A1 | 10/2008 | Cronin et al. | |
| 2013/0243209 | A1 | 9/2013 | Zurbruegg et al. | |
| 2017/0286918 | A1 | 10/2017 | Westermann et al. | |
| 2018/0103876 | A1 | 4/2018 | Davis et al. | |

(Continued)

FOREIGN PATENT DOCUMENTS

| | | |
|---|---|---|
| DE | 102020209507 | 7/2021 |
| EP | 0010168 | 4/1980 |

(Continued)

OTHER PUBLICATIONS

Extended European Search Report for EP Patent Appln. No. 21206414.1 dated Apr. 11, 2022.

(Continued)

*Primary Examiner* — Phylesha Dabney
(74) *Attorney, Agent, or Firm* — Vista IP Law Group, LLP

(57) ABSTRACT

The disclosure relates to a battery charger for one or more hearing devices, comprising: a test sound generator configured to produce testing sound; an input configured to obtain first information regarding a first microphone output of a first hearing device in response to the testing sound and obtain second information regarding a second microphone output in response to the testing sound. A processing unit is configured to detect a clogging of a filter such as a wax filter based at least in part on the first information regarding the first microphone output of the first hearing device, and based at least in part on the second information regarding the second microphone output. An output is configured to provide a signal indicating the clogging of the filter.

21 Claims, 7 Drawing Sheets

(56) References Cited

U.S. PATENT DOCUMENTS

| | | | | |
|---|---|---|---|---|
| 2019/0014429 | A1 | 1/2019 | Luke et al. | |
| 2019/0069096 | A1 | 2/2019 | Petersen et al. | |
| 2019/0349691 | A1 | 11/2019 | Ungstrup et al. | |
| 2022/0174431 | A1* | 6/2022 | Johansen | H04R 25/656 |

FOREIGN PATENT DOCUMENTS

| | | | |
|---|---|---|---|
| EP | 1333701 | | 8/2003 |
| EP | 1865746 | A2 | 12/2007 |
| EP | 2280562 | | 2/2011 |
| WO | WO 2005125276 | | 12/2005 |
| WO | WO 2011018086 | A1 | 2/2011 |
| WO | WO 2011029959 | A2 | 3/2011 |
| WO | WO 2019/238799 | | 12/2019 |
| WO | WO 2019/238800 | | 12/2019 |
| WO | WO 2019/238801 | | 12/2019 |

OTHER PUBLICATIONS

Search Report for Foreign Patent EP 1865746 dated Apr. 30, 2008.
Search Report for Foreign Patent WO 2011029959 dated Jun. 27, 2011.
1st Technical Examination for Danish Patent Appln. No. PA 2020 70745 dated Nov. 7, 2021.

* cited by examiner

DETECTION OF FILTER CLOGGING FOR HEARING DEVICES

RELATED APPLICATION DATA

This application claims priority to, and the benefit of, Danish Patent Application No. PA 2020 70745 filed on Nov. 11, 2020. The entire disclosure of the above application is expressly incorporated by reference herein.

FIELD

The field relates to hearing devices, and more particularly, to devices, systems, and methods for detecting clogging of hearing device filters.

BACKGROUND

Hearing devices, such as hearing aids, headsets, earbuds, etc., may have one or more filters such as one or more wax filters. For example, a hearing aid may have a microphone filter for protecting a microphone, and/or a receiver filter for protecting a receiver in the hearing aid.

Due to normal use of the hearing device, a hearing device filter may clog up over time. When the hearing device filter clogs up, the hearing device will not be able to output sound desirably or will not be able to output sound at all. For example, if the microphone filter is clogged up, the microphone will not be able to detect environmental sound surrounding the user. As a result, the hearing device will not be able to provide sound representative of the environmental sound to the user. Also, if the receiver filter is clogged up, the receiver of the hearing device will not be able to output sound for reception by the user of the hearing device.

Clogged hearing device filter is a significant problem for the user because if the user cannot hear sound desirably, the user may be discouraged from using the hearing device. In the case of the hearing device being a hearing aid, the user may be discouraged from using the hearing aid, and/or may incorrectly think that the user's hearing loss has gotten worse. In some cases, the user may send the hearing aid back to the manufacturer or hearing professional, thinking that the hearing aid is malfunctioned.

Sometimes, a hearing professional (e.g., a hearing aid fitter, a hearing aid retailer, etc.) may not discover the filter clogging problem when the user informs the hearing professional about performance issue with the hearing aid. The hearing professional may then send the hearing aid back to the manufacturer. The manufacturer may discover that there is nothing wrong with the hearing aid, except that the filter needs to be replaced. In the meantime, the hearing professional may provide a temporary hearing aid for the user to use until the user's hearing aid has been fixed by the manufacturer. Thus, filter replacements for hearing devices are inconvenient for hearing device users, and are costly and inefficient operations for the hearing professionals and hearing device manufacturers.

SUMMARY

A first aspect of the disclosure relates to a battery charger for one or more hearing devices comprising:

a test sound generator configured to produce testing sound; an input configured to obtain first information regarding a first microphone output of a first hearing device in response to the testing sound and obtain second information regarding a second microphone output in response to the testing sound;

a processing unit configured to detect a clogging of a filter based at least in part on the first information regarding the first microphone output of the first hearing device, and based at least in part on the second information regarding the second microphone output; and an output configured to provide a signal indicating the clogging of the filter.

Optionally, the test sound generator comprises a speaker mounted in a casing of the battery charger or a receiver or miniature speaker of the first hearing device.

Optionally, the casing comprises a first predetermined charging area, such as a cradle, slot, or opening for receipt and fixation of the first hearing device.

Optionally, the output comprises:

a display screen mounted on the casing and configured to provide a visual alert to the user indicating clogging of the filter; and/or a sound transducer mounted on the casing and configured to generate an audio alert signal to the user indicating clogging of the filter.

Optionally, the output comprises: a wired data communication interface or a wireless data communication interface connectable to an accessory device;

wherein the signal at the output causes the accessory device to emit an audio alert to the user indicating clogging of the filter and/or causes the accessory device to display a visual alert to the user indicating clogging of the filter.

Optionally, the processing unit is configured to acquire the first information regarding the first microphone output of the first hearing device and the second information regarding the second microphone output in response to a detection of a presence of at least the first hearing device in the charging area.

Optionally, the processing unit is configured to detect the presence of the first hearing device in the charging area by monitoring an electrical interface between the battery charger and the first hearing device; said electrical interface for example comprising a set of mating electrical terminals or pads arranged on the casing of the battery charger and on a housing of the first hearing device.

Optionally, the electrical interface between the battery charger and the first hearing device is configured to provide charging current from a power source of the battery charger to a rechargeable battery of the first hearing device.

Optionally, the filter comprises a wax filter, such as a mesh or a flexible membrane or diaphragm, like an air impervious membrane, of the first microphone of the first hearing device or a wax filter, such as a mesh or flexible air impervious membrane, of a first receiver or miniature speaker of the first hearing device. The wax filter may be mechanically fastened to a sound port of the microphone or a sound port of the receiver or miniature speaker.

Optionally, the casing of the battery charger comprises a user-operable lid which:

in an open state is configured to allow a user to arrange at least the first hearing device in a first predetermined charging area, such as a cradle, slot, opening, arranged in an interior of the casing; and in a closed state provides an enclosed environment, such as an acoustically sealed chamber, inside the casing of the battery charger.

Optionally, the casing of the battery charger comprises a sensor for detecting the open state and/or closed state of the lid.

Optionally, the casing of the battery charger comprises a second predetermined charging area, such as a cradle, slot, opening, arranged in the interior of the casing for receipt of a second hearing device comprising the second microphone.

Optionally, the speaker is arranged at equal distances to the first microphone of the first hearing device and second microphone of the second hearing device.

Optionally, the processing unit is configured to acquire the first information regarding the first microphone output of the first hearing device and the second information regarding the second microphone output based on a closed or open state of the user-operable lid.

Optionally, the first hearing device comprises a first microphone configured to provide the first microphone output and a receiver or miniature speaker configured to generate the test sound for detection by the first microphone.

A second aspect of the disclosure relates to an electronic device, that may be incorporated in a battery charger, which includes: an input configured to obtain first information regarding a first microphone output of a first hearing device, and second information regarding a second microphone output; a processing unit configured to detect a clogging of a filter based at least in part on the first information regarding the first microphone output of the first hearing device, and based at least in part on the second information regarding the second microphone output; and an output configured to provide a signal indicating the clogging of the filter.

Optionally, the first information regarding the first microphone output of the first hearing device comprises a power level of the first microphone output, an intensity of the first microphone output, or an energy level of the first microphone output.

Optionally, the processing unit is configured to determine a first average microphone output based on the first information.

Optionally, the processing unit is configured to compare the first information and the second information with each other.

Optionally, the processing unit is configured to compare the first information and the second information with a reference value.

Optionally, the reference value is calculated based at least in part on the first information and the second information.

Optionally, the second microphone output is associated with the first hearing device, and wherein the input is also configured to obtain third information regarding a first microphone output of a second hearing device, and fourth information regarding a second microphone output of the second hearing device.

Optionally, the processing unit is configured to perform a comparison based on the first information regarding the first microphone output of the first hearing device, the second information regarding the second microphone output associated with the first hearing device, the third information regarding the first microphone output of the second hearing device, and the fourth information regarding the second microphone output of the second hearing device.

Optionally, the processing unit is configured to determine an average value, a median value, a standard deviation, or any combination of the foregoing, based on the first information and the second information.

Optionally, the first microphone output is based on sound detected from normal use of the first hearing device.

Optionally, the electronic device is the first hearing device, or is implemented in the first hearing device.

Optionally, the first hearing device comprises a first microphone configured to provide the first microphone output, and a receiver configured to generate sound for detection by the first microphone, and wherein the first microphone output from the first microphone of the first hearing device is based on the sound generated by the receiver of first microphone.

Optionally, the first microphone is also configured to detect environmental sound.

Optionally, the receiver of the first hearing device is configured to generate the sound also for detection by a second microphone of a second hearing device, and wherein the second microphone output is associated with the second hearing device, and is based on the sound generated by the receiver of the first microphone of the first hearing device.

Optionally, the second microphone output is associated with a second hearing device, and wherein the electronic device further comprises a communication interface configured to receive the second information regarding the second microphone output of the second hearing device.

Optionally, the electronic device is an accessory device, or is implemented in the accessory device.

Optionally, the accessory device is configured to generate sound for detection by the first hearing device and/or a second hearing device; and wherein the first microphone output and the second microphone output are based on the sound generated by the accessory device.

Optionally, the accessory device is configured to wirelessly receive the first information regarding the first microphone output from the first hearing device, and to wirelessly receive the second information regarding the second microphone output.

Optionally, the accessory device is configured to obtain the first information by computing the first information based on the first microphone output, and to obtain the second information by computing the second information based on the second microphone output.

Optionally, the electronic device is a charger or is implemented in the charger.

Optionally, the charger is configured to generate sound for detection by the first hearing device and/or a second hearing device; and wherein the first microphone output and the second microphone output are based on the sound generated by the charger.

Optionally, the charger is configured to generate a control signal to cause the first hearing device and/or a second hearing device to generate sound for detection by the first hearing device and/or the second hearing device; and wherein the first microphone output and the second microphone output are based on the sound generated by the first hearing device and/or the second hearing device.

Optionally, the charger is configured to wirelessly receive the first information regarding the first microphone output from the first hearing device, and to wirelessly receive the second information regarding the second microphone output from the first hearing device or from a second hearing device.

Optionally, the charger is configured to obtain the first information by computing the first information based on the first microphone output, and to obtain the second information by computing the second information based on the second microphone output.

Optionally, the electronic device is a server or is implemented in the server.

Optionally, the second microphone output is associated with the first hearing device.

Optionally, the second microphone output is associated with a second hearing device.

Other and further aspects and features of the battery charger and electronic device will be evident from reading the following detailed description.

BRIEF DESCRIPTION OF THE DRAWINGS

The drawings illustrate the design and utility of embodiments, in which similar elements are referred to by common reference numerals. In order to better appreciate how advantages and objects are obtained, a more particular description of the embodiments will be described with reference to the accompanying drawings.

Understanding that these drawings depict only exemplary embodiments and are not therefore to be considered limiting in the scope of the claimed invention.

DESCRIPTION OF THE EMBODIMENTS

Figure 1:
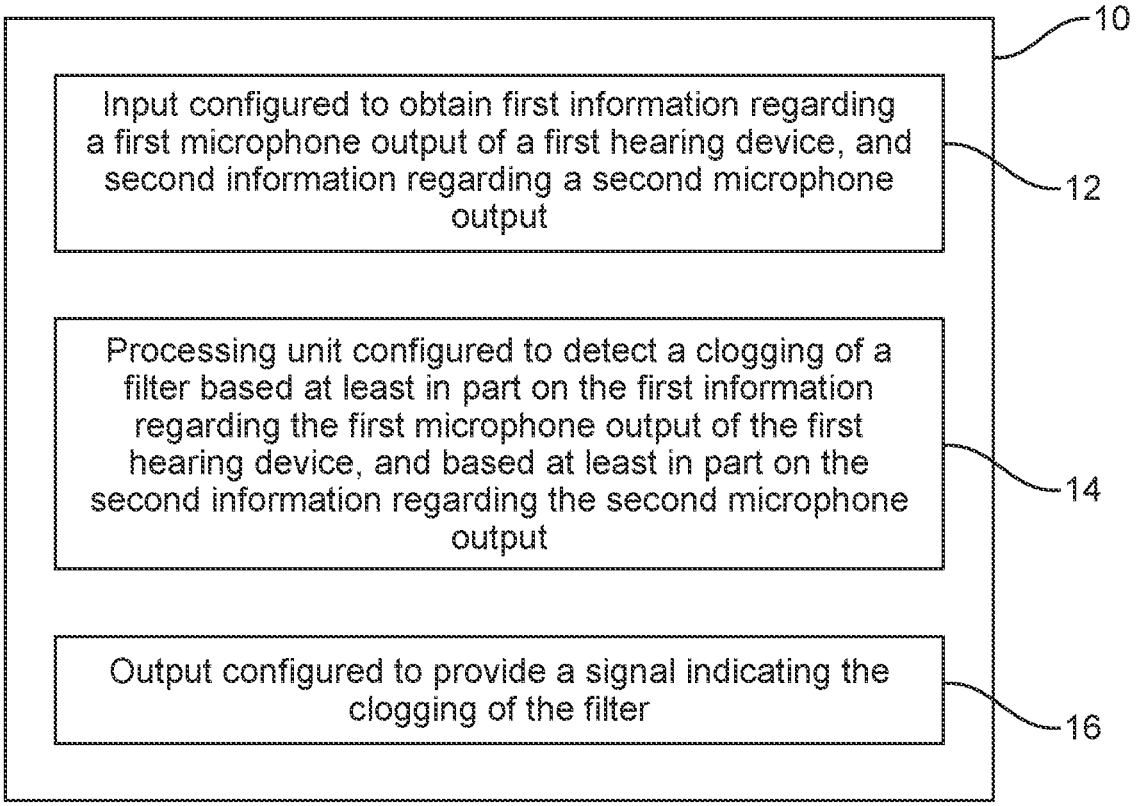
FIG. 1 illustrates an electronic device in accordance with some embodiments.

Various embodiments are described hereinafter with reference to the figures. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages of the invention shown. An aspect or an advantage described in conjunction with a particular embodiment is not necessarily limited to that embodiment and can be practiced in any other embodiments even if not so illustrated or if not so explicitly described.

FIG. 1 illustrates an electronic device 10 in accordance with some embodiments. The electronic device 10 is configured to detect clogging of a filter, such as a microphone filter, at a hearing device. The electronic device 10 includes an input 12 configured to obtain first information regarding a first microphone output of a first hearing device, and second information regarding a second microphone output. The electronic device 10 also includes a processing unit 14 configured to detect a clogging of a filter based at least in part on the first information regarding the first microphone output of the first hearing device, and based at least in part on the second information regarding the second microphone output. The electronic device 10 further includes an output 16 configured to provide a signal indicating the clogging of the filter.

The processing unit 14 of the electronic device 10 may include hardware, software, or a combination of both. By means of non-limiting examples, hardware of the processing unit 14 may include one or more processors and/or more or more integrated circuits. In some embodiments, the processing unit 14 may be implemented as a module and/or may be a part of any integrated circuit.

The input 12 of the electronic device 10 may be an input that interfaces with external devices, or may be an input internal to the electronic device 10 that is configured to communicate with a component in the electronic device 10. In some embodiments, the input 12 may be any communication interface, such as any hardware interface and/or software interface.

The output 16 of the electronic device 10 may be an output that interfaces with external devices, or may be an output internal to the electronic device 10 that is configured to communicate with a component in the electronic device 10. In some embodiments, the output 16 may be any communication interface, such as any hardware interface and/or software interface. In some embodiments, the output 16 may be configured to provide data to a storage unit (e.g., a local memory and/or a remote server). Additionally or alternatively, the output 16 may be configured to provide data to another processing unit for further processing of the data. Additionally or alternatively, the output 16 may be configured to provide data to a communication unit for communicating the data to another device (e.g., wirelessly or via a cable). Additionally or alternatively, the output 16 may be configured to provide a signal to cause a provision of an alert. For example, the signal may provision a hearing device to output an audio alert informing the user of the hearing device that the filter of the hearing device is clogged. As another example, the signal may provision an accessory device (e.g., a mobile phone, an iPad, a tablet, a remote control, a computer, a laptop, etc.) to output an audio alert and/or a visual alert informing the user of the hearing device that the filter of the hearing device is clogged. In other embodiments, the signal may provision a hearing professional device to provide a message to inform a hearing professional (e.g., a fitter) that the hearing device needs filter replacement. In further embodiments, the signal may provision a message to inform a hearing device manufacturer that the hearing device needs filter replacement.

The electronic device 10 may be any device, or may be implemented in any device. In some embodiments, the electronic device 10 may be the hearing device with the filter, or may be implemented as a part of the hearing device with the filter. In other embodiments, the electronic device 10 may be an accessory device, or may be implemented as a part of the accessory device. Examples of accessory device include mobile phone, iPad, tablet, computer, laptop, remote control, etc. In other embodiments, the electronic device 10 may be a charger for charging the hearing device with the filter, or may be implemented as a part of the charger. In further embodiments, the electronic device 10 may be a server, or may be implemented as a part of the server. In some embodiments, the server may be a server associated with (e.g., owned, controlled by, affiliated with, etc.) a hearing device manufacturer, or associated with a hearing professional. In still further embodiments, the electronic device 10 may be a hearing professional device, or may be implemented as a part of the hearing professional device.

Each of the first information and the second information may be any information that is useable by the processing unit 14 to perform a process for identifying clogged filter for the hearing device. By means of non-limiting examples, the first information regarding the first microphone output of the first hearing device may be a power level of the first microphone output, an intensity of the first microphone output, an energy level of the first microphone output, any characteristic associated with the first microphone output, etc. Similarly, by means of non-limiting examples, the second information regarding the second microphone output may be a power level of the second microphone output, an intensity of the second microphone output, an energy level of the second microphone output, any characteristic associated with the second microphone output, etc.

In some embodiments, the second microphone output is associated with the first hearing device. In such cases, both the first information regarding the first microphone output and the second information regarding the second microphone output are associated with the first hearing device. For example, the first hearing device may include a first microphone for providing the first microphone output, and a second microphone for providing the second microphone output. The first and second microphones of the first hearing device may be configured as a directional microphone that provides sound information with directionality.

In other embodiments, the second microphone output is associated with a second hearing device that is different from the first hearing device. The first and second hearing devices may be parts of a binaural hearing system, wherein the first and second hearing devices are left and right hearing devices, or vice versa. In such cases, the first information regarding the first microphone output is associated with the first hearing device, and the second information regarding the second microphone output is associated with the second hearing device. For example, the first hearing device may include a first microphone for providing the first microphone output, and a second microphone for providing the second microphone output.

Various techniques may be employed by the processing unit 14 to determine whether a filter of the hearing device is clogged.

In some embodiments, the processing unit 14 may be configured to compare the first information and the second information with each other. In one implementation, sound may be provided for detection by the microphones that provide the first and second microphone outputs. If neither one of the microphones is clogged, the microphones are expected to provide microphone outputs with similar characteristics (e.g., power levels, energy levels, etc. of the respective microphone outputs). In such cases, if the comparison between the first and second information indicate that a microphone output has a characteristic level that is significantly lower than the other microphone output, then the processing unit 14 may determine that the microphone with the significantly lower microphone output characteristic has a clogged filter.

Alternatively or additionally, the processing unit 14 may be configured to compare the first information and the second information with a reference value. For example, for a given level outputted from a sound source (e.g., speaker) that is positioned at certain distances from the respective microphones, the microphone outputs of the respective microphones may be determined to have certain expected levels. In such cases, if any of the first and second information is below the expected level (or below the expected level by more than a certain threshold), then the processing unit 14 may determine the microphone filter corresponding with the information (i.e., the one that is below the expected level) as being clogged.

In some embodiments, the electronic device 10 may also include a non-transitory medium storing reference values (e.g., expected levels of microphone outputs) in association with speaker-to-microphone distances and/or in association with volumes of sound output by the speaker. In such cases, depending on the volume of the sound output by the speaker and/or distance between the speaker to the microphone, the processing unit 14 can select the corresponding reference value for comparison with the information regarding microphone output received by the input 12.

In other embodiments, the reference value may be calculated based at least in part on the first information and the second information. For example, the reference value may be an average value or a median value. In such cases, the processing unit 14 may be configured to compare information (e.g., level of microphone output) with the average value or the median value. If the level of microphone output is below the average value or the median value, or is lower than the average value or the median value by a certain threshold, then the processing unit 14 may determine the corresponding microphone filter as being clogged.

In some embodiments, there may be two hearing devices (e.g., left and right hearing devices), each having at least two microphones. In particular, the first hearing device may have a first microphone and a second microphone, and the second hearing device may also have a first microphone and a second microphone. In such cases, the input 12 of the electronic device 10 may be configured to obtain first information and second information regarding the first and second microphone outputs of the first hearing device, and also to obtain third information regarding the first microphone output of a second hearing device, and fourth information regarding the second microphone output of the second hearing device. The processing unit 14 may be configured to perform a comparison based on the first information regarding the first microphone output of the first hearing device, the second information regarding the second microphone output associated with the first hearing device, the third information regarding the first microphone output of the second hearing device, and the fourth information regarding the second microphone output of the second hearing device.

In one or more embodiments described herein, the processing unit 14 may be configured to determine an average value, a median value, a standard deviation, or two or more of the foregoing, based on the first information and the second information (wherein the first information and the second information may be regarding microphone outputs from a same first hearing device, or from different respective first and second hearing devices). The average value, the median value, the standard deviation, or any combination of the foregoing, may be utilized in a metric determining scheme to determine a metric that identifies a microphone with a clogged filter. In the situation in which there are two hearing devices, each having multiple microphones, the processing unit 14 may be configured to determine an average value, a standard deviation, or both, based on the first information and the second information regarding microphone outputs provided by microphones of the first hearing device, and also based on the third information and the fourth information regarding microphone outputs provided by microphones of the second hearing device.

In some embodiments, the processing unit 14 may be configured to determine an average value or a median value of the information obtained by the input 12. If any of the information regarding the microphone outputs has a value that is below the average value or the median value by more than a certain threshold (e.g., by a factor times the standard deviation), then the processing unit 14 may determine that the microphone filter associated with the corresponding information is clogged.

In some embodiments, the first information regarding the first microphone output of the first hearing device may include multiple values over time (e.g. a waveform). In such cases, the processing unit 14 is configured to determine a first average microphone output based on the first information (e.g. by determining an average of the values). In other embodiments, the processing unit 14 may be configured to determine a maximum value from the plurality of values in the first information. In further embodiments, the first information regarding the first microphone output of the first hearing device may itself be an average value calculated from multiple values of the first microphone output, or a maximum value determined from the multiple values of the first microphone output. The above examples of the first information, and the above examples of processing of the first information, may be similarly applied for the second information and/or other information, such as the third information, the fourth information, etc.

In the above examples, the microphone output(s) is described as being based on sound output from a speaker that is detected by the microphone(s) of the hearing device 20. In some embodiments, the speaker providing the sound for detection by the microphone(s) of the hearing device 20 may be the receiver of the hearing device 20. In other embodiments, the speaker providing the sound for detection by the microphone(s) of the hearing device 20 may be a component of another device, such as a receiver of another hearing device (e.g. a contralateral hearing device), an accessory device, a charger, a computer, a laptop, a testing device, etc. In further embodiments, the sound detected by the microphone(s) of the hearing device 20 may be any environmental sound from any sound source, such as from a speaker, a moving vehicle, a construction equipment, a concert, etc. In the embodiments in which the electronic device 10 is implemented in the hearing device 20, the microphone output(s) may be based on sound detected from normal use of the hearing device 20.

Figure 2:
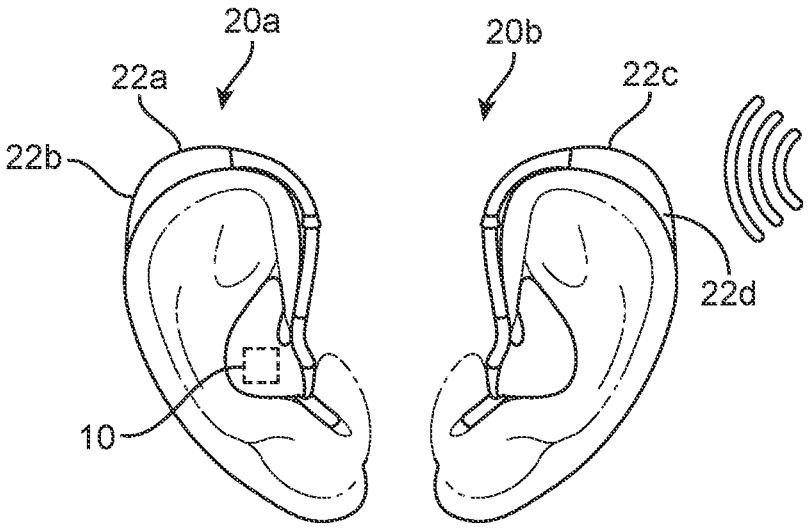
FIG. 2 illustrates an example of a hearing device that includes the electronic device of FIG. 1 in accordance with some embodiments.

FIG. 2 illustrates an example of a hearing device 20*a* (first hearing device 20*a*) that includes the electronic device 10 of FIG. 1. As shown in the figure, the electronic device 10 is implemented in the first hearing device 20*a*. In the illustrated embodiments, the first hearing device 20*a* has a first microphone 22*a* and a second microphone 22*b*. There is also a second hearing device 20*b* having a first microphone 22*c* and a second microphone 22*d*. In the illustrated embodiments, the hearing devices 20*a*, 20*b* are respective hearing aids configured for worn at the left and right ears (or vice versa) of a user.

During normal use, the microphones 22*a*-22*d* of the hearing devices 20*a*, 20*b* pick up environmental sound outside the user of the hearing devices 20*a*, 20*b*. The hearing devices 20*a*, 20*b* process the detected sound to compensate for a hearing loss of the user, and provide output sound (via respective receivers of the hearing devices 20*a*, 20*b*) for reception by eardrums of the user.

In some embodiments, when the user of the hearing devices 20*a*, 20*b* is in an environment with environmental sound, the microphones 22*a*-22*d* of the hearing devices 20*a*, 20*b* pick up the environmental sound, and generate corresponding microphone outputs. The input 12 of the electronic device 10 in the first hearing device 20*a* obtains information regarding the microphone outputs from the microphones 22*a*, 22*b* of the first hearing devices 20*a*. The first hearing device 20*a* receives, via a communication unit, information regarding the microphone outputs from the microphones 22*c*, 22*d* of the second hearing device 20*b*. The information regarding the microphone outputs from the microphones 22*c*, 22*d* is then obtained by the input 12 of the electronic device 10 in the first hearing device 20*a*. The processing unit 14 in the electronic device 10 then compares the information regarding the microphone outputs from the microphones 22*a*-22*d*. The information regarding the microphone outputs may be the microphone outputs themselves, or may be any information regarding characteristics of the microphone outputs (e.g., power levels, energy levels, amplitudes, etc.).

In some cases, the microphone outputs from the microphones 22*a*-22*d* may have different respect levels due to environmental sound coming from certain directions, and/or due to head-shadowing effect. However, if the filters for the microphones 22*a*-22*d* are not clogged, the microphone outputs from the microphones 22*a*-22*d* may all fall within a certain range (which considers direction of sound and/or head-shadowing effect). In some embodiments, the processing unit 14 is configured to determine whether any of the microphone outputs from the microphones 22*a*-22*d* is outside and below such range. If so, the processing unit 14 may then determine that the filter for the microphone (i.e., the one with the microphone output being below and outside the range) is clogged. For example, if none of the microphones 22*a*-22*d* has any clogged filter, the microphone outputs may have the values 48 dB, 46 dB, 52 dB, 50 dB. On the other hand, if a microphone has a clogged filter, the resulting microphone outputs may have the values 48 dB, 46 dB, 52 dB, 4 dB. In such cases, the microphone with the 4 dB microphone output may be determined as having a clogged filter.

In some embodiments, the processing unit 14 is configured to determine the range (for evaluation of the microphone outputs) based on the microphone outputs from the microphones 22*a*-22*d* or from a subset of the microphones 22*a*-22*d*. In one implementation, the processing unit 14 may be configured to identify the microphone output with the lowest level, and calculate an average of the levels of the remaining microphone outputs (i.e., excluding the one with the lowest level). The processing unit 14 may then compare the lowest level of the microphone output with the calculated average. If the lowest level of the microphone output (i.e., the one excluded from the calculation of the average) is below the calculated average by more than a percentage P, then the processing unit 14 may determine that the filter for the corresponding microphone (the one providing the lowest level of microphone output) is clogged. The percentage P may be equal to or higher than: 10%, 20%, 30%, 40%, 50%, 60%, 70%, 80%, 90%, 95%, etc. The percentage P may be determined based on consideration of sound direction and/or head-shadow effect. In some embodiments, the percentage P may be variable as a function of volume of the detected sound.

In another implementation, the processing unit 14 may be configured to identify the microphone outputs with the lowest level and the highest level, and calculate an average of the levels of the remaining microphone outputs (i.e. excluding the one with the lowest level, and the one with the highest level). The processing unit 14 may then compare the lowest level of the microphone output with the calculated average. If the lowest level of the microphone output (i.e. the one excluded from the calculation of the average) is below the calculated average by more than a percentage P, then the processing unit 14 may determine that the filter for the corresponding microphone (the one providing the lowest level of microphone output) is clogged. The percentage P may be any of the examples mentioned, and may be determined based on consideration of sound direction and/or head-shadow effect. Also, as similarly described, the percentage P may be variable as a function of volume of the detected sound.

In some embodiments, the processing unit 14 may be configured to repeatedly perform the above evaluation of the microphone outputs, and keep track of which one of the microphones has a lowest output, or has a lowest output that satisfies a criterion (e.g., has a level that is below an average by the percentage P), for each one of the evaluations. If a certain microphone repeatedly or consistently has the lowest output in the evaluations that are performed at different times, then the processing unit 14 may determine that the filter for that microphone is clogged. Alternatively, if a certain microphone has the lowest output in more times than other microphones, then the processing unit 14 may determine that the filter for that microphone is clogged. Evaluating the microphone outputs at multiple times in order to determine clogged filter is advantageous because a low output by a microphone in one situation may be due to sound direction, head-shadowing effect, and/or an object (e.g., finger) temporarily blocking the microphone port. If a microphone output from one microphone has the lowest output in different environments (e.g. which may have different sound directions, and/or may have different associated head-shadowing effect) at different times, then it is more likely than not that such microphone has a clogged filter. In some embodiments, the processing unit 14 may be configured to keep track of the number of times and/or frequency in which each microphone provides the lowest microphone output. If the number of times and/or frequency for a certain microphone is higher than those for the other microphones (e.g., by a certain threshold, such as by more than 20%, more than 30%, more than 40%, more than 50%, more than 60%, more than 70%, more than 80%, more than 90%, etc.), then the processing unit 14 may determine that such microphone has a clogged filter. Also, in some embodiments, the processing unit 14 may be configured to keep track and update a histogram of microphone performances, and to use the histogram in the determination of clogged filter.

In some embodiments, the evaluations of microphone outputs, and/or the storing of the results of the evaluations, by the processing unit 14 may be performed in response to the environmental sound being higher than a threshold. This feature is advantageous because louder environmental sound (e.g. construction noise, concert noise, etc.) may be less impacted by head-showing effect compared to more quiet environmental sound. For example, in some embodiments, the evaluation of microphone performances is performed by the processing unit 14 only in response to detection of sound that is above 20 dB, above 30 dB, above 40 dB, above 50 dB, above 60 dB, etc.

In some embodiments, after the processing unit 14 has identified a clogged filter, the processing unit 14 may then generate a signal for indicating the clogging of the filter, and may provide the signal via the output 16. In some embodiments, the generated signal may cause the receiver of the hearing device 20 to output an audio alert (e.g., a beep, a message, etc.) for informing the user of the hearing device 20 that there is a clogged filter. Optionally, the audio alert may also indicate to the user which of the hearing devices 20*a*, 20*b* has the clogged filter. Upon receiving the alert, the user may then contact the hearing professional and/or the hearing device manufacturer to arrange for a replacement of the filter.

Alternatively or additionally, the signal provided via the output 16 may be transmitted (e.g., wirelessly) to an accessory device, which causes the accessory device to provide an alert (e.g., an audio alert and/or visual alert) to the user. The accessory device may be a mobile phone, an iPad, a tablet, a computer, a laptop, a remote control, a charger, etc. Upon receiving the alert, the user may then contact the hearing professional and/or the hearing device manufacturer to arrange for a replacement of the filter.

Alternatively or additionally, the signal provided via the output 16 may be transmitted to a server via a network, such as the Internet. The server may be associated with (e.g. controlled by, owned by, affiliated with, etc.) a hearing device manufacturer and/or a hearing professional. In such cases, the hearing device manufacturer may provide a replacement filter to the user or to a hearing professional. In some cases, the hearing device manufacturer may inform the hearing professional regarding the clogged filter, so that the hearing professional can arrange to replace the filter for the user. In some embodiments, the hearing device manufacturer may assist the hearing professional in making arrangements to replace the filter.

Alternatively or additionally, the signal provided via the output 16 may be transmitted to a hearing professional device via a network, such as the Internet. The hearing professional device then provides an alert to a hearing professional. The hearing professional may then contact the user of the hearing device to arrange for a replacement of the filter. In some embodiments, the signal received by the hearing professional device may cause the hearing professional device to display a message to inform the hearing professional about the clogged filter of the hearing device 20. The hearing professional may then contact the user of the hearing device 20 to arrange for a replacement of the filter. The hearing professional may also contact the hearing device manufacturer regarding filter replacement. In one implementation, after the hearing professional device receives the signal, the hearing professional device may inform the hearing professional, through a graphical user interface, about the clogged filter of the hearing device 20. The hearing professional device may include an application for generating the graphical user interface. The application may also be configured to assist the hearing professional 80 to connect with the user of the hearing device 20, and/or to help the user in a process to replace the filter of the hearing device 20. In some embodiments, the application may allow the hearing professional to order replacement filter for the user.

The above technique of evaluating microphone outputs to determine clogged filter is advantageous because the evaluations take place while the user is wearing the hearing devices 20*a*, 20*b* during normal use. Accordingly, the evaluations happen "behind the scene" without the user being aware of them. There is no special test that needs to be performed with the user's participation. Also, there is no need for the user to take off the hearing devices 20*a*, 20*b* in order for the evaluations to be performed.

Figure 3:
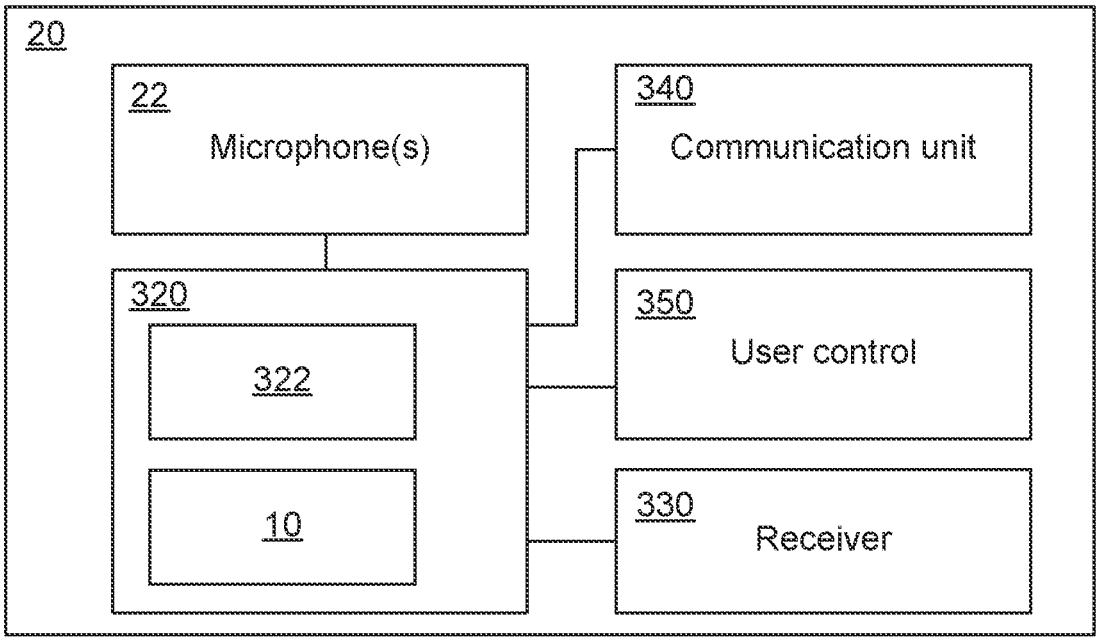
FIG. 3 illustrates an example of the hearing device of FIG. 2.

FIG. 3 illustrates an example of the hearing device 20 (e.g., hearing device 20*a* or 20*b*) of FIG. 2. The hearing device 20 includes one or more microphone 22, a hearing loss compensation unit 322, a receiver 330, a communication unit 340, and a user control 350. The hearing device 20 also includes the electronic device 10. The hearing loss compensation unit 322 and the electronic device 10 may be implemented as parts of a processing module 320, which may be a processing unit such as a processor, an integrated circuit, application, functional module, etc. In other embodiments, the hearing loss compensation unit 322 and the electronic device 10 may be separate components. The microphone(s) 22 is configured to receive sound from an environment outside the user of the hearing device 20, and generate a microphone signal based on the received sound. The hearing loss compensation unit 322 is configured to perform signal processing to compensate for a hearing loss of the user, and to generate an output based on the microphone signal from the microphone(s) 22. The receiver 330 is configured to generate sound for reception by an eardrum of the user based on the output from the hearing loss compensation unit 322. The communication unit 340 is configured to communicate with one or more devices, such as another hearing device 20 of the user, an accessory device, a server, a hearing professional device, etc. The communication unit 340 may be one or more wireless communication units and/or one or more cable connectors. In some embodiments, the communication unit 340 may include one or more antennas. The user control 350 may be one or more buttons, one or more knobs, one or more switches, or any combination of the foregoing. The user control 350 is configured to allow the user of the hearing device 20 to control an operation of the hearing device 20. For example, the user may operate the user control 350 to adjust a volume of sound, to change an operation mode of the hearing device 20, to change a hearing program of the hearing device 20, to change an operation parameter of the hearing device 20, etc.

The hearing device 20 may be a hearing aid, such as an in-the-canal (ITC) hearing aid, a completely-in-canal (CIC) hearing aid, an invisible-in-the-canal (IIC) hearing aid, a receiver-in-the-ear (RITE) hearing aid, a receiver-in-canal (RIC) hearing aid, etc.

In other embodiments, the hearing device 20 may not be a hearing aid. Instead, the hearing device 20 may be a headset, an earbud, a hearing protection device, etc. In some embodiments, the hearing device 20 may not include the hearing loss compensation unit 322. In other embodiments, the hearing device 20 may include a processing unit configured to provide signal processing related to the hearing of the user. For example, the processing unit may be configured to perform noise reduction, noise cancellation, speech recognition, bass adjustment, treble adjustment, fad balancing, processing of user input, etc.

In the above embodiments, the electronic device 10 is described as being implemented inside a hearing device 20. In other embodiments, the electronic device 10 may be an accessory device, or may be implemented as a part of the accessory device. The accessory device may be a mobile phone, an iPad, a tablet, a charger, a computer, a laptop, a remote control, etc.

Figure 4:
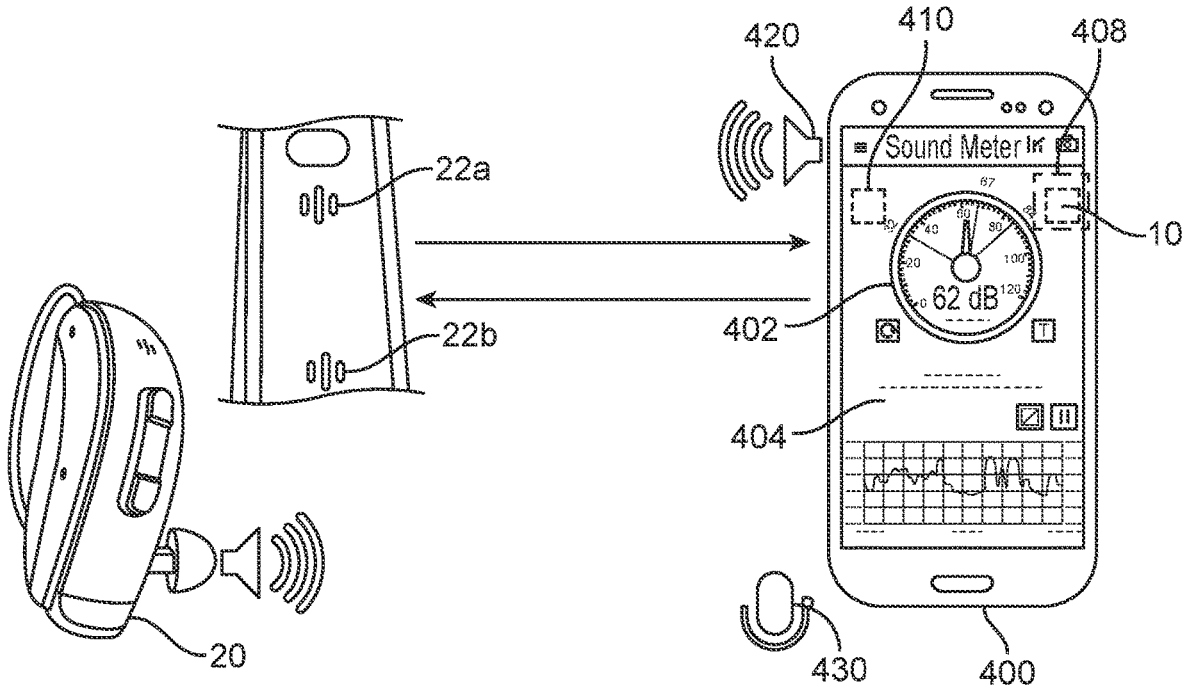
FIG. 4 illustrates an example of an accessory device that includes the electronic device of FIG. 1.

FIG. 4 illustrates an example of an accessory device 400 that includes the electronic device 10 of FIG. 1. In the illustrated embodiments, the accessory device 400 is a mobile phone. The accessory device 400 includes a user interface 402 configured to receive user input, a screen 404 configured to display information regarding the hearing device 20, a processing unit 408, and a communication unit 410 configured to communicate with the hearing device 20 and other devices. In the illustrated example, the user interface 402 is a touchscreen implemented using the screen 404. In other embodiments, the user interface 402 may be one or more buttons, one or more knobs, one or more switches, a keyboard, a mouse, a touchpad, a trackball, a graphical interface through which a user can enter one or more inputs, or any device and/or application that is capable of receiving user input. The processing unit 408 may include hardware, software, or a combination of both. By means of non-limiting examples, hardware of the processing unit 408 may include one or more processors and/or one or more integrated circuits. In the illustrated embodiments, the electronic device 10 is implemented as a part of the processing unit 408 of the accessory device 400. The communication unit 410 may be a wireless unit configured to perform wireless communication, or a cable interface configured to output data to, and to receive data from, a cable. In other embodiments, the communication unit 410 may be any communication interface, such as a hardware interface or software interface. In some embodiments, the communication unit 410 may comprise one or more antennas configured to communication with one or more devices, such as with the hearing device 20, a hearing professional device, a server, a storage device, etc.

The operation of the electronic device 10 in the accessory device 400 for processing microphone outputs from microphones of the hearing device(s) 20 is the same as that described with reference to the embodiments of FIGS. 2-3, except that the input 12 of the electronic device 10 receives the microphone outputs from the hearing device(s) 20 wirelessly via a communication unit 410 in the accessory device 400 (because the electronic device 10 is in the accessory device 10 instead of the hearing device 20). In particular, in some embodiments, the microphones 22 of the hearing device 20 detect environmental sound while the user is wearing the hearing device 20, and the microphones 22 generate corresponding microphone outputs. Information regarding the microphone outputs are then transmitted wireless from the hearing device 20 to the accessory device 400. The information may be the microphone outputs themselves or may be any information regarding any characteristic of the microphone outputs. The communication unit 410 of the accessory device 400 receives the information regarding the microphone outputs, and passes the information to the input 12 of the electronic device 10 in the accessory device 400. The processing unit 14 of the electronic device 10 then processes the information to determine if a filter of the hearing device 20 is clogged or not.

Although one hearing device 20 is shown in FIG. 4, in other embodiments, there may be two hearing devices 20 (e.g. first and second hearing devices 20*a*, 20*b*, as similarly described with reference to FIG. 2).

In other embodiments, instead of using environmental sound during normal use of the hearing device 20 to determine clogging of the filter in the hearing device 20, the accessory device 400 may have a speaker 420 for providing a testing sound for detection by the microphones 22 of the hearing device 20. In such cases, the hearing device 20 and/or the accessory device 400 may provide an audio message informing the user of the hearing device 20 that a filter clogging test is being conducted, and/or an audio message informing the user that the accessory device 400 will output a testing sound. This way, the user will not be confused or surprised by the testing sound. The microphones 22 of the hearing device 20 may detect the testing sound while the user is wearing the hearing device 20 or while the hearing device 20 is unworn (e.g., the user may place the hearing device 20 at a designated distance or location from the speaker 420 of the accessory device 400), and the microphones 22 generate corresponding microphone outputs. Information regarding the microphone outputs (which are based on the testing sound generated by the speaker 420 of the accessory device 400) are then transmitted (wirelessly or via a cable) from the hearing device 20 to the accessory device 400. The communication unit 410 of the accessory device 400 receives the information regarding the microphone outputs, and passes the information to the input 12 of the electronic device 10 in the accessory device 400. The processing unit 14 of the electronic device 10 then processes the information to determine if a filter of the hearing device 20 is clogged or not.

In some embodiments, after the processing unit 14 has identified a clogged filter, the processing unit 14 may then generate a signal for indicating the clogging of the filter, and may provide the signal via the output 16. In some embodiments, the generated signal may cause the accessory device 400 to provide an audio alert and/or a visual alert for informing the user of the hearing device 20 that there is a clogged filter in the hearing device 20. Optionally, the audio alert may also indicate to the user which of the hearing devices 20*a*, 20*b* has the clogged filter.

Alternatively or additionally, the signal provided via the output 16 may be transmitted (e.g., wirelessly) to the hearing device 20, which causes the hearing device 20 to provide an audio alert (e.g. a beep, a message, etc.) for informing the user of the hearing device 20 that there is a clogged filter.

Alternatively or additionally, the signal provided via the output 16 may be transmitted from the accessory device 400 to a server via a network, such as the Internet. The server may be associated with (e.g. controlled by, owned by, affiliated with, etc.) a hearing device manufacturer and/or a hearing professional. In such cases, the hearing device manufacturer may provide a replacement filter to the user or to a hearing professional. In some cases, the hearing device manufacturer may inform the hearing professional regarding the clogged filter, so that the hearing professional can arrange to replace the filter for the user. In some embodiments, the hearing device manufacturer may assist the hearing professional in making arrangements to replace the filter.

Alternatively or additionally, the signal provided via the output 16 may be transmitted from the accessory device 400 to a hearing professional device via a network, such as the Internet. The hearing professional device then provides an alert to a hearing professional. The hearing professional may then contact the user of the hearing device to arrange for a replacement of the filter. The hearing professional may also contact the hearing device manufacturer to order a replacement filter.

Figure 5:
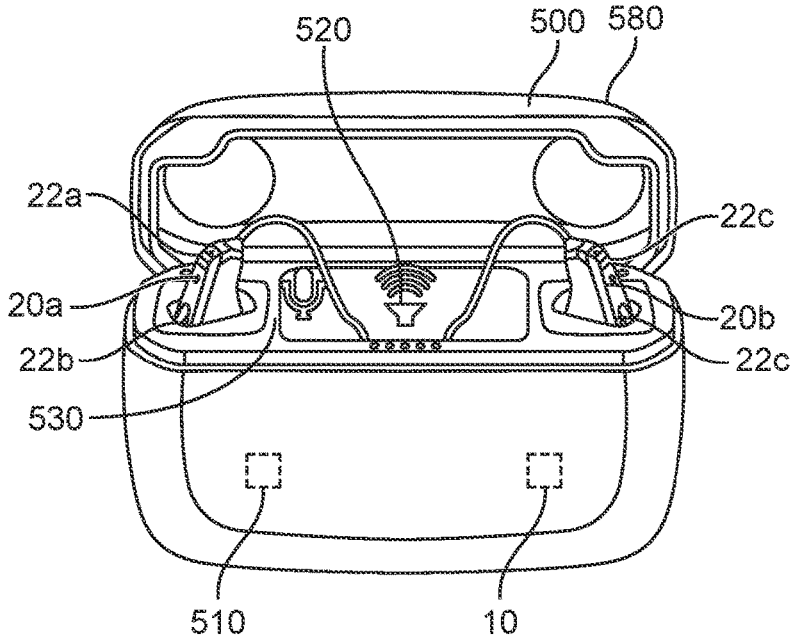
FIG. 5 illustrates an exemplary accessory device in form of a battery charger that may include the electronic device of FIG. 1.

In other embodiments, the electronic device 10 for detecting a clogged filter of a hearing device 20 may be implemented in a battery charger 500 that is configured for charging one or more rechargeable batteries of the hearing device 20. FIG. 5 illustrates an example of a battery charger 500 that includes the electronic device 10 of FIG. 1. The operation of the electronic device 10 in the charger 500 for processing microphone outputs from microphones of the hearing device(s) 20 may be the same as that described with reference to the embodiments of FIGS. 2-3, except that the input 12 of the electronic device 10 receives the microphone outputs from the hearing device(s) 20 via a communication unit 510 in the charger 500 because the electronic device 10 is in the charger 500 instead of the hearing device 20. In particular, in some embodiments, the microphones 22 of the hearing device 20 detect testing sound, and the microphones 22 generate corresponding microphone outputs. Information regarding the microphone outputs are then transmitted from the hearing device 20 to the electronic device 10 in the charger 500. The transmission of the information may be performed wirelessly. Alternatively, the transmission may be performed via electrical contact(s). For example, the charger 500 may include charging contact(s) (e.g. pads). In such cases, the charging contact(s) itself or another electrical contact next to the charging contact may be utilized to transmit the information from the hearing device 20 to the input 12 of the device 10 in the charger 500. The information may be the microphone outputs themselves or may be any information regarding any characteristic of the microphone outputs. The communication unit 510 of the charger 500 receives the information regarding the microphone outputs, and passes the information to the input 12 of the electronic device 10 in the charger 500. The processing unit 14 of the electronic device 10 then processes the information to determine if a filter of the hearing device 20 is clogged or not.

In some embodiments, the test sound generator may be provided in the hearing device for example such that the testing sound is generated by a receiver or miniature speaker of the hearing device 20*a*, a receiver or miniature speaker of the hearing device 20*b*, or by both. In such cases, the processing unit 14 of the electronic device 10 in the charger 500 may be configured to generate a control signal to cause the hearing device 20*a* and/or the hearing device 20*b* to output testing sound. In other embodiments, the battery charger 500 may have a speaker 520 for providing the testing sound for detection by the microphone(s) of the hearing device 20*a* and the microphone(s) of the hearing device 20*b*.

It should be noted that using the battery charger 500 to perform evaluation of microphone outputs of the hearing devices 20*a*, 20*b* is advantageous because the battery charger 500 provides a controlled environment for the evaluation of the microphone outputs. In particular, because the battery charger 500 has charging areas (e.g., cradle slots, openings, etc.), when the hearing devices 20*a*, 20*b* are placed in the charging areas, the microphones of the hearing devices 20*a*, 20*b* will be at specific pre-determined distances from the source of the testing sound. If the battery charger 500 has the speaker 520, the speaker 520 may be configured to provide a testing sound in the form of a tone with known (predetermined) frequency and/or volume (dB). In other embodiments, if the battery charger 500 does not have any speaker, a controller in the charger 500 may be configured to generate a signal to cause a receiver of the hearing device 20*a*, a receiver of the hearing device 20*b*, or both, to generate testing sound. Alternatively, the hearing device 20*a* and/or the hearing device 20*b* may be configured to detect a presence of the charger 500 and/or an electrical connection with electrical contacts of the battery charger 500. In response to such detection, the receiver of the hearing device 20*a*, the receiver of the hearing device 20*b*, or both, then generates testing sound.

In some embodiments, the speaker 520 of the battery charger 500 is located between two charging areas for the two hearing devices 20*a*, 20*b*, and is at equal distance to the two hearing devices 20*a*, 20*b*. Optionally, the charging area and the speaker 520 may be configured such that the speaker 520 will be at equal distance to all four microphones 22*a*-22*d* when the hearing devices 20*a*, 20*b* are placed in the charging area.

The above features are advantageous because they remove variation of expected microphone outputs based on sound direction.

In some embodiments, the battery charger 500 has a casing with a lid 500. In such cases, the evaluation of the microphone outputs may be performed in response to the battery charger 500 sensing the presence of the hearing devices 20*a*, 20*b*, and/or in response to a closing of the lid 500. The battery charger 500 may include one or more sensors for sensing a state of the lid 580 (e.g., whether the lid 580 is opened or closed). Performing evaluation of microphone outputs of the hearing devices 20*a*, 20*b* in an enclosed environment inside the battery charger 500 is advantageous because it prevents outside noise from interfering with the evaluation of the microphone outputs.

In some embodiments, after the processing unit 14 in the battery charger 500 has identified a clogged wax filter, the processing unit 14 may then generate a signal for indicating the clogging of the filter, and may provide the signal via the output 16. In some embodiments, the generated signal may cause the speaker 520 of the battery charger 500 to provide an audio alert for informing the user of the hearing devices 20*a*, 20*b* that there is a clogged filter. Optionally, the audio alert may also indicate to the user which of the hearing devices 20*a*, 20*b* has the clogged filter. Alternatively or additionally, the battery charger 500 may have a display screen, which may provide a visual alert for informing the user that there is a clogged filter and/or for indicating to the user which of the hearing devices 20*a*, 20*b* has the clogged filter.

Alternatively or additionally, the signal provided via the output 16 may be transmitted (e.g., wirelessly) to an accessory device, which causes the accessory device to provide an audio alert (e.g. a beep, a message, etc.) for informing the user of the hearing devices 20*a*, 20*b* that there is a clogged filter, and/or an alert that indicates to the user which of the hearing devices 20*a*, 20*b* has the clogged filter.

Alternatively or additionally, the signal provided via the output 16 may be transmitted (e.g., wirelessly) to the hearing device 20, which causes the hearing device 20 to program a future audio alert (e.g. a beep, a message, etc.) to be provided (i.e., after the hearing device 20 is removed from the battery charger 500 and is placed in the user's ear) by the hearing device 20 for informing the user of the hearing device 20 that there is a clogged filter. Alternatively, the signal provided via the output 16 may be transmitted (e.g., wirelessly) to the hearing device 20, which causes the hearing device 20 to program a future audio alert (e.g. a beep, a message, etc.) to be provided (i.e. after the hearing device 20 is removed from the battery charger 500 and is placed in the user's ear) by the hearing device 20 for informing the user of the hearing device 20 that there is a clogged filter.

Alternatively or additionally, the signal provided via the output 16 may be transmitted from the battery charger 500 to a server via a network, such as the Internet. The server may be associated with (e.g. controlled by, owned by, affiliated with, etc.) a hearing device manufacturer. In such cases, the hearing device manufacturer may provide a replacement filter to the user or to a hearing professional. In some cases, the hearing device manufacturer may inform the hearing professional regarding the clogged filter, so that the hearing professional can arrange to replace the filter for the user. In some embodiments, the hearing device manufacturer may assist the hearing professional in making arrangements to replace the filter. In some embodiments, in response to receipt of the signal, the hearing device manufacturer may send a replacement filter to the hearing professional or to the user of the hearing device 20.

Alternatively or additionally, the signal provided via the output 16 may be transmitted from the battery charger 500 to a hearing professional device via a network, such as the Internet. The hearing professional device then provides an alert to a hearing professional. The hearing professional may then contact the user of the hearing device to arrange for a replacement of the filter. The hearing professional may also contact the hearing device manufacturer to order a replacement filter.

Figure 6:
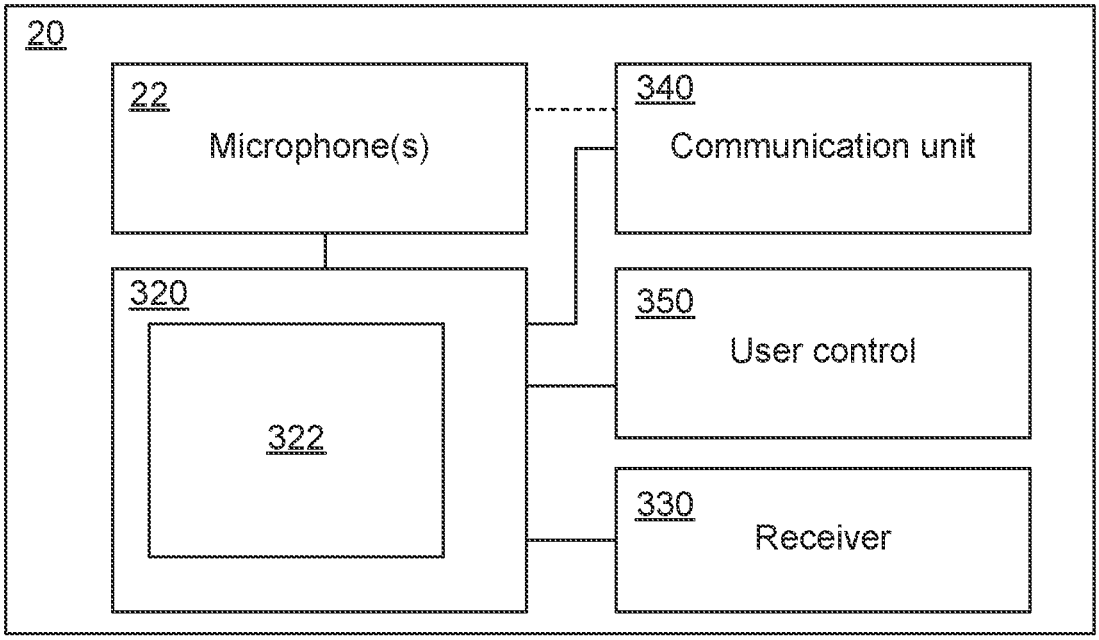
FIG. 6 illustrates another example of a hearing device in accordance with some embodiments.

In the embodiments of FIG. 4 and FIG. 5, the hearing device 20 does not include the electronic device 10 that is configured to detect a clogged filter. Accordingly, microphone outputs from the hearing device 20 are transmitted from the hearing device 20 to another device (e.g., the accessory device 400, the battery charger 500, etc.) that includes the electronic device 10 for detecting the clogged filter. FIG. 6 illustrates an example of the hearing device 20 that is configured to provide microphone outputs to another device that includes the electronic device 10 for detecting a clogged filter.

The hearing device 20 includes one or more microphone 22, a hearing loss compensation unit 322, a receiver 330, a communication unit 340, and a user control 350. The hearing loss compensation unit 322 may be implemented as parts of a processing module 320, which may be a processing unit such as a processor, an integrated circuit, application, functional module, etc. The microphone(s) 22 is configured to receive sound from an environment outside the user of the hearing device 20, and generate a microphone signal based on the received sound. The hearing loss compensation unit 322 is configured to perform signal processing to compensate for a hearing loss of the user, and to generate an output based on the microphone signal from the microphone(s) 22. The receiver 330 is configured to generate sound for reception by an eardrum of the user based on the output from the hearing loss compensation unit 322. The communication unit 340 is configured to communicate with one or more devices, such as another hearing device 20 of the user, an accessory device, a server, a hearing professional device, etc. The communication unit 340 may be one or more wireless communication units and/or one or more cable connectors. In some embodiments, the communication unit 340 may include one or more antennas. The user control 350 may be one or more buttons, one or more knobs, one or more switches, or any combination of the foregoing. The user control 350 is configured to allow the user of the hearing device 20 to control an operation of the hearing device 20. For example, the user may operate the user control 350 to adjust a volume of sound, to change an operation mode of the hearing device 20, to change a hearing program of the hearing device 20, to change an operation parameter of the hearing device 20, etc.

In some embodiments, the processing module 320 is configured to obtain microphone output(s) from the microphone(s), and process the microphone output(s). By means of non-limiting examples, processing of the microphone output(s) may include, filtering, feature extraction, formatting, time-stamping, classification, evaluation, etc., or any combination of the foregoing. After the processing module 320 has processed the microphone output(s) to obtain the information regarding the microphone output(s), the processing module 320 then passes the information to the communication unit 340 for transmission of the information. In other embodiments, at least part of the processing module 320 for processing microphone output(s) may be incorporated or integrated with the microphone(s). In such cases, the microphone(s) may provide the information regarding the microphone output(s) to the communication unit 340 (as represented by the dashed line in the figure).

The hearing device 20 may be a hearing aid, such as an in-the-canal (ITC) hearing aid, a completely-in-canal (CIC)

hearing aid, an invisible-in-the-canal (IIC) hearing aid, a receiver-in-the-ear (RITE) hearing aid, a receiver-in-canal (RIC) hearing aid, etc.

In some embodiments, the evaluation of microphone outputs of the hearing devices 20*a*, 20*b* may be performed in real-time by the electronic device 10. In other embodiments, information regarding the microphone outputs may be stored in a non-transitory medium, and the information may be processed at a later time to determine whether there is a clogged filter. For example, the information regarding the microphone outputs of the hearing devices 20*a*, 20*b* may be stored as data in a non-transitory medium in one or both of the hearing devices 20*a*, 20*b*, in a non-transitory medium in the battery charger 500, in a non-transitory medium in the accessory device 400 (e.g. mobile phone), in a server or a storage device (e.g., a cloud storage), in a hearing professional device, etc. In some embodiments, the server or the storage device receiving the information may be a server or a storage device of a hearing device manufacturer.

Figure 7:
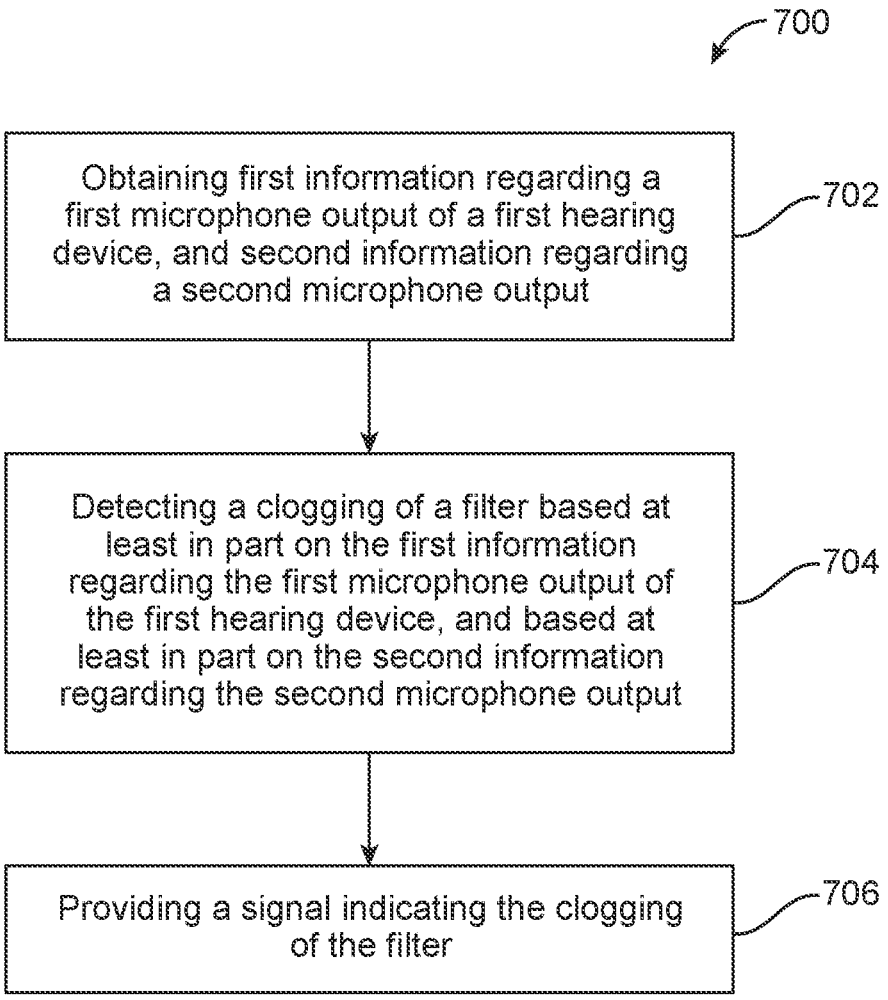
FIG. 7 illustrates a method for detecting a clogging of a filter of a hearing device.

FIG. 7 illustrates a method 700 for detecting a clogging of a filter of a hearing device. The method 700 may be performed by the electronic device 10, which may be a server or may be implemented in the server (e.g. the server 40), may be an accessory device or may be implemented in the accessory device (e.g. the accessory device 30), may be a hearing device or may be implemented in the hearing device (e.g. the hearing device 10), or a combination of two or more of the foregoing. The method 700 includes obtaining first information regarding a first microphone output of a first hearing device, and second information regarding a second microphone output (item 702). The method 700 also includes detecting a clogging of a filter based at least in part on the first information regarding the first microphone output of the first hearing device, and based at least in part on the second information regarding the second microphone output (item 704). The method 700 further includes providing a signal indicating the clogging of the filter (item 706).

Some embodiments of the device(s), system, and method described herein for determining clogged filter of the hearing device 20 are advantageous because they do not require the user to perform any specific test to identify a clogged filter. Instead, the microphone outputs of the hearing device 20 are monitored during normal use of the hearing device 20 (e.g. while user is wearing the hearing device 20, while the hearing device 20 is placed in a battery charger, etc.), and the monitored microphone outputs are utilized to determine whether the filter of the hearing device 20 is clogged. Accordingly, the user 70 may not even be aware that microphone outputs are being monitored and evaluated to help identify clogging of the filter.

The techniques of determining a clogged filter described herein are also advantageous because they assist the user in identifying a clogged filter, so that the user will not erroneously wonder whether his/her hearing loss has worsened. Furthermore, the device(s), system, and method described herein assists a hearing professional and/or a hearing device manufacturer to provide filter replacement timely and effectively for the user of the hearing device 20.

Also, in some embodiments, the technique described herein may allow detection of clogging of filter of the hearing device 20 before the filter is completely clogged. For example, the technique described herein may allow detection of clogging of filter when the filter is at least 50% clogged, at least 60% clogged, at least 70% clogged, at least 80% clogged, at least 90% clogged, etc. In other embodiments, the technique described herein may allow detection of clogging of the filter when the filter is completely clogged. Accordingly, when used in this specification, the term "clogged" or any of other similar terms such as "clogging" refer to a condition of a filter that may or may not be completely clogged, such as a condition of a filter that is at least 50% clogged, at least 60% clogged, at least 70% clogged, at least 80% clogged, or at least 90% clogged.

In the above embodiments, the electronic device 10 is described as being configured to detect a clogging of a microphone filter of the hearing device 20. Alternatively, or additionally, the electronic device 10 may be configured to detect a clogging of a receiver filter of the hearing device 20. In one implementation, the receiver of the hearing device 20 may be configured to generate testing sound. The testing sound is not based on any environmental sound detected by the microphone(s) of the hearing device 20. Instead, the testing sound provided by the receiver of the hearing device 20 is based on a control signal, that is either generated from within the hearing device 20, or is generated by another device (in communication with the hearing device 20) outside the hearing device 20 and transmitted to the hearing device 20. In some embodiments, the testing sound may be a tune that is predetermined and stored in the hearing device 20 or in the other device that is in communication with the hearing device 20. In other embodiments, the testing sound may be an artificially created sound generated based on sound parameter(s).

In some embodiments, the detection of clogged receiver filter may be performed by the hearing device 20 while the hearing device 20 is being worn by the user. During use, the user is informed that a test is being conducted to test the receiver. The receiver is then controlled to output the testing sound. For example, a processing unit in the hearing device 20 may generate a control signal to provision the testing sound. Alternatively, another device (e.g. an accessory device such as a mobile phone) may generate a control a signal that is wirelessly transmitted to the hearing device 20 to provision the testing sound. If the user cannot hear the testing sound, then it may indicate that the filter of the receiver is clogged. In some embodiments, the hearing device 20 may also include an ear-canal microphone for detecting sound inside an ear canal of the user. In such cases, the ear-canal microphone may detect the testing sound outputted by the receiver. If the ear-canal microphone cannot detect the testing sound, or if the detected testing sound is below an expected volume of the testing sound by a certain percentage, then it may be determined that the receiver filter is clogged. The determination of the clogged receiver filter may be performed by the electronic device 10. In such cases, the electronic device 10 is configured to detect both clogged microphone filter and clogged receiver filter.

In other embodiments, the hearing device 20 may be removed from the user, and may be placed in a testing environment for determining whether there is a clogged receiver filter. In such cases, an accessory device, such as the accessory device 400 of FIG. 4, may be placed at a certain distance from the receiver of the hearing device 20. The accessory device then generates a control signal to cause the receiver of the hearing device 20 to output a testing sound. A microphone (e.g., microphone 430) of the accessory device may then attempt to detect the testing sound. If the microphone of the accessory device cannot detect the testing sound, or if the detected testing sound is below an expected volume of the testing sound by a certain percentage, then it may be determined that the receiver filter of the hearing device 20 is clogged. The determination of the clogged receiver filter may be performed by the electronic device 10 in the accessory device in this embodiment.

In further embodiments, the hearing device 20 may be removed from the user, and may be placed in the battery charger 500 for determining whether there is a clogged receiver filter. In such cases, the battery charger 500 may generate a control signal to cause the receiver of the hearing device 20 to output a testing sound. A microphone (e.g., microphone 530) of the battery charger 500 may then attempt to detect the testing sound. If the microphone of the battery charger 500 cannot detect the testing sound, or if the detected testing sound is below an expected volume of the testing sound by a certain percentage, then it may be determined that the receiver filter of the hearing device 20 is clogged. The determination of the clogged receiver filter may be performed by the electronic device 10 in the battery charger 500 in this embodiment.

In some embodiments, the electronic device 10 may be configured to identify both clogged microphone filter and clogged receiver filter for a hearing device 20. For detecting clogged receiver filter, the input 12 of the electronic device 10 may be configured to obtain information regarding receiver output (corresponding with detected output sound from the receiver of the hearing device 10), and the processing unit 14 of the electronic device 10 may be configured to compare the information regarding the receiver output with a reference value. The information regarding the receiver output may be the receiver output itself, or any characteristic (such as volume) of the receiver output. In some embodiments, the reference value represents an expected volume level of the microphone output, and the reference value may be stored in a non-transitory medium associated with (e.g. in) the electronic device 10.

Figure 8:
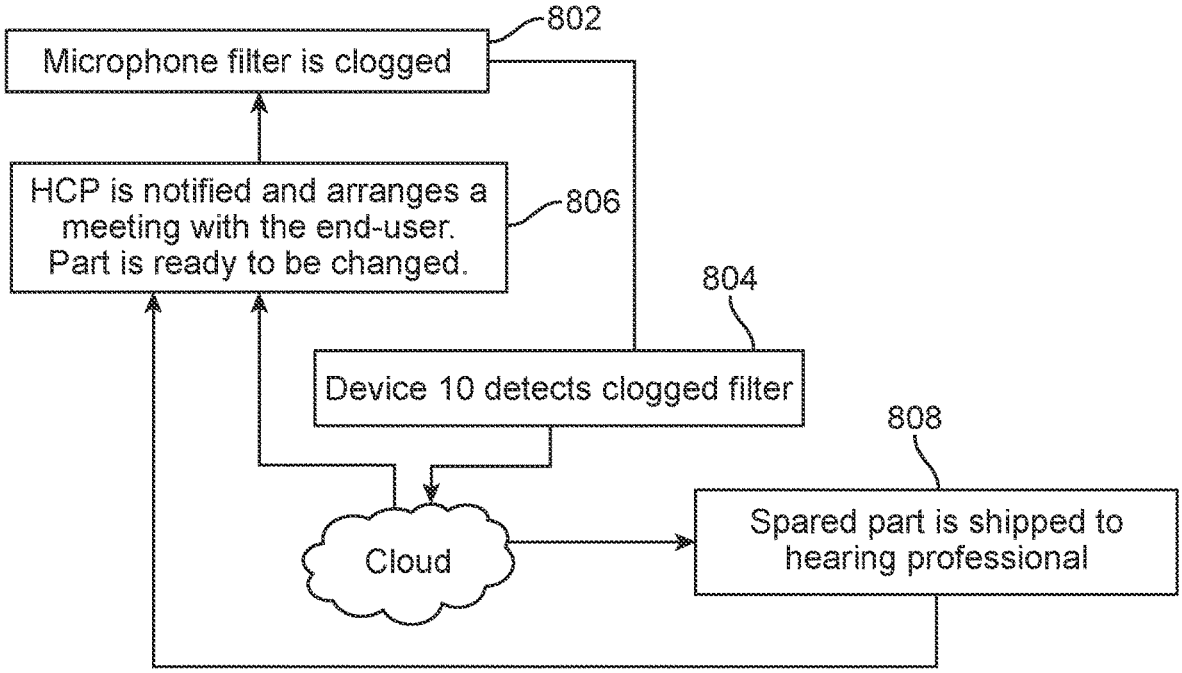
FIG. 8 illustrates an example of a workflow for replacing a clogged filter of a hearing device.

FIG. 8 illustrates an example of a workflow for replacing a clogged filter of a hearing device. As shown in item 802, a microphone filter of the hearing device is clogged. The user of the hearing device may or may not notice a degradation in the performance of the hearing device. In item 804, the electronic device 10 performs the diagnostics, and determines that the microphone filter is clogged. The diagnostic result may be transmitted to a server device (e.g. Cloud) for storage. The server device may be associated with a hearing device manufacturer and/or a hearing professional. In item 806, the server device informs the hearing professional, and the hearing professional then arranges a meeting with the user of the hearing device for replacing the clogged filter. Before the meeting, the server also informs a filter provider about the need for a replacement filter. The filter provider ships the replacement filter to the hearing professional before the meeting with the user takes place. Accordingly, when the user meets up with the hearing professional, the replacement filter will be available for replacing the clogged filter. It should be noted that the workflow of FIG. 8 is only an example, and that other variations of the workflow are possible.

Specialized Processing System

Figure 9:
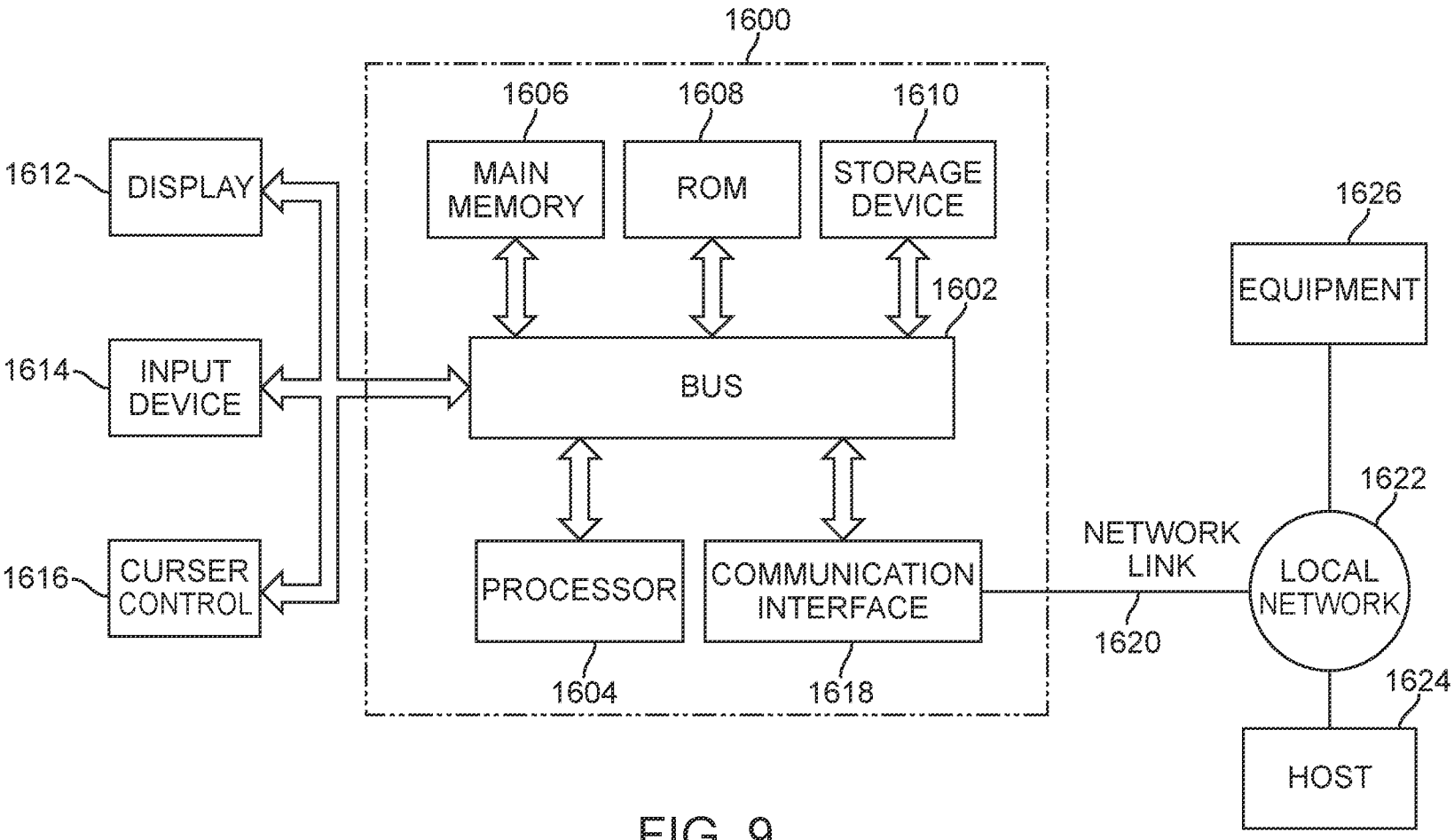
FIG. 9 illustrates a specialized processing system for implementing one or more electronic devices described herein.

FIG. 9 illustrates a specialized processing system for implementing one or more electronic devices described herein. For examples, the processing system 1600 may implement the accessory device 400, the battery charger 500, the server, or the hearing professional device.

Processing system 1600 includes a bus 1602 or other communication mechanism for communicating information, and a processor 1604 coupled with the bus 1602 for processing information. The processor system 1600 also includes a main memory 1606, such as a random access memory (RAM) or other dynamic storage device, coupled to the bus 1602 for storing information and instructions to be executed by the processor 1604. The main memory 1606 may also be used for storing temporary variables or other intermediate information during execution of instructions to be executed by the processor 1604. The processor system 1600 further includes a read only memory (ROM) 1608 or other static storage device coupled to the bus 1602 for storing static information and instructions for the processor 1604. A data storage device 1610, such as a magnetic disk or optical disk, is provided and coupled to the bus 1602 for storing information and instructions.

The processor system 1600 may be coupled via the bus 1602 to a display 167, such as a screen or a flat panel, for displaying information to a user. An input device 1614, including alphanumeric and other keys, or a touchscreen, is coupled to the bus 1602 for communicating information and command selections to processor 1604. Another type of user input device is cursor control 1616, such as a mouse, a trackball, or cursor direction keys for communicating direction information and command selections to processor 1604 and for controlling cursor movement on display 167. This input device typically has two degrees of freedom in two axes, a first axis (e.g., x) and a second axis (e.g. y), that allows the device to specify positions in a plane.

In some embodiments, the processor system 1600 can be used to perform various functions described herein. According to some embodiments, such use is provided by processor system 1600 in response to processor 1604 executing one or more sequences of one or more instructions contained in the main memory 1606. Those skilled in the art will know how to prepare such instructions based on the functions and methods described herein. Such instructions may be read into the main memory 1606 from another processor-readable medium, such as storage device 1610. Execution of the sequences of instructions contained in the main memory 1606 causes the processor 1604 to perform the process steps described herein. One or more processors in a multi-processing arrangement may also be employed to execute the sequences of instructions contained in the main memory 1606. In alternative embodiments, hard-wired circuitry may be used in place of or in combination with software instructions to implement the various embodiments described herein. Thus, embodiments are not limited to any specific combination of hardware circuitry and software.

The term "processor-readable medium" as used herein refers to any medium that participates in providing instructions to the processor 1604 for execution. Such a medium may take many forms, including but not limited to, non-volatile media, volatile media, and transmission media. Non-volatile media includes, for example, optical or magnetic disks, such as the storage device 1610. A non-volatile medium may be considered an example of non-transitory medium. Volatile media include dynamic memory, such as the main memory 1606. A volatile medium may be considered an example of non-transitory medium. Transmission media include coaxial cables, copper wire and fiber optics, including the wires that comprise the bus 1602. Transmission media can also take the form of acoustic or light waves, such as those generated during radio wave and infrared data communications.

Common forms of processor-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a processor can read.

Various forms of processor-readable media may be involved in carrying one or more sequences of one or more instructions to the processor 1604 for execution. For example, the instructions may initially be carried on a magnetic disk of a remote computer. The remote computer can load the instructions into its dynamic memory and send the instructions over a network, such as the Internet or a local network. A receiving unit local to the processing system 1600 can receive the data from the network, and provide the data on the bus 1602. The bus 1602 carries the data to the main memory 1606, from which the processor 1604 retrieves and executes the instructions. The instructions received by the main memory 1606 may optionally be stored on the storage device 1610 either before or after execution by the processor 1604.

The processing system 1600 also includes a communication interface 1618 coupled to the bus 1602. The communication interface 1618 provides a two-way data communication coupling to a network link 1620 that is connected to a local network 1622. For example, the communication interface 1618 may be an integrated services digital network (ISDN) card or a modem to provide a data communication connection to a corresponding type of telephone line. As another example, the communication interface 1618 may be a local area network (LAN) card to provide a data communication connection to a compatible LAN. Wireless links may also be implemented. In any such implementation, the communication interface 1618 sends and receives electrical, electromagnetic or optical signals that carry data streams representing various types of information.

The network link 1620 typically provides data communication through one or more networks to other devices. For example, the network link 1620 may provide a connection through local network 1622 to a host computer 1624 or to equipment 1626. The data streams transported over the network link 1620 can comprise electrical, electromagnetic or optical signals. The signals through the various networks and the signals on the network link 1620 and through the communication interface 1618, which carry data to and from the processing system 1600, are exemplary forms of carrier waves transporting the information. The processing system 1600 can send messages and receive data, including program code, through the network(s), the network link 1620, and the communication interface 1618.

It should be noted that the term "filter" is not limited to microphone filter, and may include receiver filter, depending on the context. Also, embodiments described herein are not limited to hearing devices having one filter per microphone, and may apply to a filter that covers both microphones if the hearing device has multiple microphones.

It should be noted that the term "detect" (e.g. detect a clogging of a filter) or other similar terms such as "detecting" includes the act or function of determining (e.g. determining a result or condition based on an algorithm or process), and should not be limited to the act or function of sensing.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly. to be regarded in an illustrative rather than restrictive sense. The claimed invention is intended to cover all alternatives, modifications and equivalents.

The invention claimed is:

1. A battery charger for one or more hearing devices, the one or more hearing devices comprising a first hearing device, the battery charger comprising:

an input configured to obtain first information regarding a first microphone output of the first hearing device, and to obtain second information regarding a second microphone output, wherein the first microphone output is based on a testing sound;

a processing unit configured to detect a clogging of a filter based at least in part on the first information regarding the first microphone output of the first hearing device, and based at least in part on the second information regarding the second microphone output; and an output configured to provide a signal indicating the clogging of the filter.

2. The battery charger of claim 1, wherein the testing sound is from a receiver or miniature speaker of the first hearing device.

3. The battery charger of claim 1, further comprising a test sound generator configured to provide the testing sound.

4. The battery charger of claim 3, wherein the test sound generator comprises a speaker mounted at a casing of the battery charger.

5. The battery charger of claim 4, wherein the casing comprises a first predetermined charging area for receipt of the first hearing device.

6. The battery charger according to claim 1, wherein the output comprises:

a display screen configured to provide a visual alert indicating the clogging of the filter; and/or a sound transducer configured to generate an audio alert indicating the clogging of the filter;

wherein the signal is the visual alert and/or the audio alert.

7. The battery charger according to claim 1, wherein the output comprises a wired data communication interface or a wireless data communication interface communicatively connectable to an accessory device.

8. The battery charger according to claim 7, wherein the signal from the wired data communication interface or from the wireless data communication interface is configured to cause the accessory device to emit an audio alert indicating the clogging of the filter and/or to display a visual alert indicating the clogging of the filter.

9. The battery charger according to claim 1, wherein the processing unit is configured to acquire the first information regarding the first microphone output of the first hearing device and the second information regarding the second microphone output after a detection of a presence of at least the first hearing device in a charging area of the battery charger.

10. The battery charger according to claim 9, wherein the processing unit is configured to detect the presence of the first hearing device in the charging area by monitoring an electrical interface between a part of the battery charger and a part of the first hearing device.

11. The battery charger according to claim 10, wherein the electrical interface comprises a first electrical element at the casing of the battery charger, and a second electrical element at the first hearing device.

12. The battery charger according to claim 10, wherein the electrical interface is configured to provide charging current from a power source of the battery charger to a rechargeable battery of the first hearing device.

13. The battery charger according to claim 1, wherein the filter comprises a wax filter.

14. The battery charger according to claim 1, wherein the filter comprises a mesh or a membrane associated with a first microphone of the first hearing device.

15. The battery charger according to claim 1, wherein the filter comprises a mesh or a membrane associated with a receiver or a miniature speaker of the first hearing device.

16. The battery charger according to claim 1, further comprising a casing, wherein the casing of the battery charger comprises a user-operable lid:

wherein when the lid is in an open state, the first hearing device can be placed in a first predetermined charging area in an interior of the casing; and wherein when the lid is in a closed state, the lid is configured to provide an enclosed environment.

17. The battery charger according to claim 16, further comprising a sensor configured to detect the open state and/or the closed state of the lid.

18. The battery charger according to claim 16, wherein the casing of the battery charger comprises a second predetermined charging area in the interior of the casing for receipt of a second hearing device.

19. The battery charger according to claim 18, further comprising a speaker at equal distances to a first microphone of the first hearing device and a second microphone of the second hearing device when the first and second hearing devices are positioned at the first and second predetermined charging areas, respectively, in the interior of the casing.

20. The battery charger according to claim 1, further comprising a casing, wherein the casing comprises a lid, and wherein the processing unit is configured to acquire the first information regarding the first microphone output of the first hearing device and the second information regarding the second microphone output based on a state of the lid.

21. The battery charger according to claim 1, wherein the first hearing device comprises a first microphone configured to provide the first microphone output, and a receiver or miniature speaker configured to generate the test sound for detection by the first microphone of the first hearing device.

* * * * *